US008831462B2

(12) United States Patent
Mushika et al.

(10) Patent No.: US 8,831,462 B2
(45) Date of Patent: Sep. 9, 2014

(54) DEVELOPING CARTRIDGE AND IMAGE FORMING APPARATUS FOR PROTECTING AN ELECTRODE FROM DAMAGE DURING HANDLING

(71) Applicants: Motoaki Mushika, Hashima (JP); Yasuo Fukamachi, Nagoya (JP)

(72) Inventors: Motoaki Mushika, Hashima (JP); Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/088,952

(22) Filed: Nov. 25, 2013

(65) Prior Publication Data

US 2014/0079430 A1 Mar. 20, 2014

Related U.S. Application Data

(63) Continuation of application No. 13/033,486, filed on Feb. 23, 2011, now Pat. No. 8,594,526.

(30) Foreign Application Priority Data

Feb. 23, 2010 (JP) ..... 2010-037768

(51) Int. Cl.
*G03G 15/00* (2006.01)
*G03G 21/18* (2006.01)
*G03G 21/16* (2006.01)

(52) U.S. Cl.
CPC ..... *G03G 21/1652* (2013.01); *G03G 21/186* (2013.01); *G03G 21/1647* (2013.01); *G03G 21/1871* (2013.01); *G03G 2221/166* (2013.01)
USPC ..... 399/90

(58) Field of Classification Search
CPC ..... G03G 2221/166; G03G 21/1652; G03G 21/1867; B65H 3/0669
USPC ..... 399/90, 119, 117, 167
See application file for complete search history.

(56) References Cited

U.S. PATENT DOCUMENTS 8,594,526 B2 * 11/2013 Mushika et al. ..... 399/90
2001/0028811 A1 10/2001 Kojima et al.

(Continued)

FOREIGN PATENT DOCUMENTS

EP 1542096 A1 6/2005
JP H03-042156 A 4/1991

(Continued)

OTHER PUBLICATIONS

Japan Patent Office, Decision of Patent Grant for Japanese Patent Application No. 2010-037768 (counterpart to above-captioned patent application), dispatched Dec. 13, 2011.

(Continued)

*Primary Examiner* — Billy Lactaoen
(74) *Attorney, Agent, or Firm* — Baker Botts L.L.P.

(57) ABSTRACT

A developing cartridge includes a housing including first and second sidewalls; a developing roller, received by the sidewalls, and rotatable about a first axis line; a coupling rotatable about a second axis line parallel with the first axis line, wherein the coupling transfers rotational force to the developing roller, the rotational force being input by an drive input part, which advances and retreats, in a direction along the second axis line; and a moving member received so that the moving member can be moved along the advancing and retreating direction. The moving member has a pushing part, which is pushed toward the second sidewall, and an electrode part, which applies developing bias, and wherein when the pushing part is pushed, the moving member moves toward the second sidewall, so that the electrode part protrudes more from the second sidewall than before the pushing part was pushed.

20 Claims, 14 Drawing Sheets

(56) References Cited

U.S. PATENT DOCUMENTS

| | | | |
|---|---|---|---|
| 2003/0185594 | A1 | 10/2003 | Okabe |
| 2005/0135832 | A1 | 6/2005 | Kubota et al. |
| 2006/0029418 | A1 | 2/2006 | Ishii et al. |
| 2006/0029419 | A1 | 2/2006 | Shiraki |
| 2006/0029420 | A1 | 2/2006 | Ishii et al. |
| 2006/0029421 | A1 | 2/2006 | Ishii et al. |
| 2006/0029422 | A1 | 2/2006 | Shiraki |
| 2006/0029423 | A1 | 2/2006 | Shiraki |
| 2006/0110181 | A1 | 5/2006 | Kubota et al. |
| 2007/0009281 | A1 | 1/2007 | Sato et al. |
| 2007/0009282 | A1 | 1/2007 | Sato et al. |

FOREIGN PATENT DOCUMENTS

| | | | |
|---|---|---|---|
| JP | H06-051629 | A | 2/1994 |
| JP | 2000112200 | A | 4/2000 |
| JP | 2000-275967 | A | 10/2000 |
| JP | 2001-003944 | A | 1/2001 |
| JP | 2001-228781 | A | 8/2001 |
| JP | 2003-295614 | A | 10/2003 |
| JP | 2005-017758 | A | 1/2005 |
| JP | 2006-072284 | A | 3/2006 |
| JP | 2007-102152 | A | 4/2007 |
| JP | 2008-242085 | A | 10/2008 |
| JP | 2008-298804 | A | 12/2008 |
| JP | 2009-098316 | A | 5/2009 |

OTHER PUBLICATIONS

European Patent Office, Extended European Search Report for Patent Application No. 11001509.6 (corresponds to above-captioned patent application), dated Oct. 23, 2012.

* cited by examiner

LEFT ⟷ RIGHT

LEFT ← → RIGHT

LEFT ⟷ RIGHT

LEFT ⟷ RIGHT

LEFT ⟷ RIGHT

DEVELOPING CARTRIDGE AND IMAGE FORMING APPARATUS FOR PROTECTING AN ELECTRODE FROM DAMAGE DURING HANDLING

This application is a continuation of U.S. patent application Ser. No. 13/033,486 filed on Feb. 23, 2011, which claims the benefit of priority of Japanese Patent Application No. 2010-037768 filed on Feb. 23, 2010, the entire contents of each of which are incorporated herein by reference in their entirety.

TECHNICAL FIELD

Devices and apparatuses consistent with the present invention relate to a developing cartridge and an image forming apparatus.

BACKGROUND ART

In general, a developing cartridge has been known which is detachably mounted to an image forming apparatus, such as laser printer. The developing cartridge has a housing that accommodates developer therein, a developing roller, an electrode that applies developing bias to the developing roller, and the like.

SUMMARY

According to the conventional developing cartridge, since the electrode protrudes excessively from the housing to the outside, the electrode may be damaged or broken during handling of the developing cartridge such as when conveying or attaching/detaching the developing cartridge.

Exemplary embodiments of the invention have been made with these problems and an object of one aspect of the invention is to protect an electrode when handing a detachable developing cartridge.

One aspect of the invention provides a developing cartridge comprising:

a housing, which accommodates developer therein, the housing including:

a first sidewall and a second sidewall, which is opposed to the first sidewall;

a developing roller, which is received by the first sidewall and the second sidewall, and is rotatable about a first axis line;

a coupling, which is disposed at the first sidewall, and is rotatable about a second axis line parallel with the first axis line, wherein the coupling transfers rotational force to the developing roller, the rotational force being input by an outside drive input part, which advances and retreats, with respect to the first sidewall, in a direction along the second axis line; and a moving member extending so that the moving member connects the first and second sidewalls and received so that the moving member can be moved along the advancing and retreating direction of the drive input part, wherein the moving member has:

a pushing part at the first sidewall, which is pushed toward the second sidewall by a pushing force from the drive input part, and an electrode part at the second sidewall, which applies developing bias to the developing roller, and wherein if the pushing part is pushed by the pushing force of the drive input part, the moving member moves toward the second sidewall, so that the electrode part protrudes more from the second sidewall than before the pushing part was pushed.

BRIEF DESCRIPTION OF THE DRAWINGS

FIGS. 7A and 7B are enlarged sectional views showing a configuration of a developing cartridge according to a second exemplary embodiment, in which FIG. 7A shows a state before an output coupling is engaged and FIG. 7B shows a state after the output coupling is engaged.

FIGS. 8A to 8C are enlarged sectional views showing a configuration of a developing cartridge according to a third exemplary embodiment, in which FIG. 8A shows a state before an output coupling is engaged, FIG. 8B shows a state in which an input coupling pushed by the output coupling contacts a moving member and FIG. 8C shows a state in which the moving member is pushed by pushing force of the output coupling.

FIGS. 9A and 9B are enlarged sectional views showing a configuration of a developing cartridge according to a fourth exemplary embodiment, in which FIG. 9A shows a state before an output coupling is engaged and FIG. 9B shows a state after the output coupling is engaged.

FIGS. 10A and 10B are enlarged sectional views showing a configuration of a developing cartridge according to a fifth exemplary embodiment, in which FIG. 10A shows a state before an output coupling is engaged and FIG. 10B shows a state after the output coupling is engaged.

FIGS. 11A and 11B are enlarged sectional views showing a configuration of a developing cartridge according to a modified embodiment, in which FIG. 11A shows a state before an output coupling is engaged and FIG. 11B shows a state after the output coupling is engaged.

FIGS. 12A and 12B are enlarged sectional views showing a configuration of a developing cartridge according to another modified embodiment, in which FIG. 12A shows a state before an output coupling is engaged and FIG. 12B shows a state after the output coupling is engaged.

FIGS. 13A and 13B show a configuration of a main body-side electrode according to a modified embodiment, in which FIG. 13A shows a state after a moving member is moved by pushing force of a driving input part and FIG. 13B shows a state after the pushing of the driving input part is released.

DESCRIPTION OF PREFERRED EXEMPLARY EMBODIMENTS

First Exemplary Embodiment

A first exemplary embodiment will be described with reference to the accompanying drawings. In the below descriptions, a schematic configuration of a laser printer 1 that is an example of an image forming apparatus and a configuration for inputting driving force to a developing cartridge 100 will be first described and then configurations of the developing cartridge 100, which are characteristics of exemplary embodiments of the invention, will be described in detail.

In the below descriptions, the directions are set on the basis of a user who uses the laser printer 1. Specifically, in FIG. 1, the right side, the left side, the front side and the inner side are referred to as "front," "back," "left" and "right," respectively. In addition, the upper and lower directions in FIG. 1 are referred to as an "upper-lower" direction.

<Schematic Configuration of Laser Printer>

Figure 1:
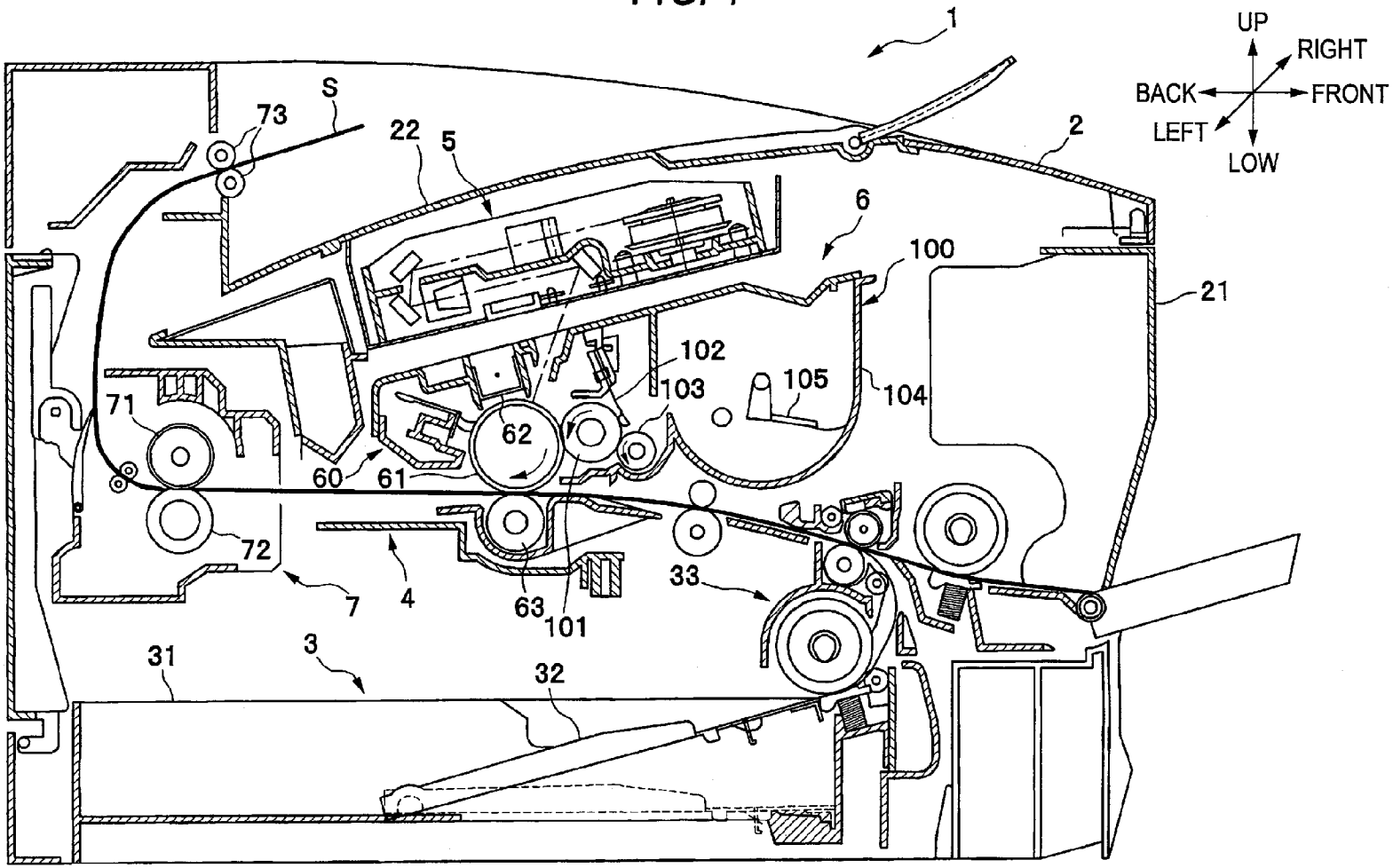
FIG. 1 shows a schematic configuration of a laser printer that is an example of an image forming apparatus according to an exemplary embodiment of the invention.

As shown in FIG. 1, the laser printer 1 has a feeder unit 3 that feeds sheets S in a body casing 2 and an image forming unit 4 that forms an image on the sheet S.

The feeder unit 3 has a sheet feeding tray 31, a sheet pressing plate 32 and a sheet feeding mechanism 33. The sheets S in the sheet feeding tray 31 are upwardly inclined by the sheet pressing plate 32 and supplied to the imaging forming unit 4 by the sheet feeding mechanism 4.

The image forming unit 4 has an exposure unit 5, a developing unit 6 and a photographic fixing unit 7.

The exposure unit 5 has a laser light emitting unit, a polygon mirror, a reflector and the like, which are not shown. The exposure unit 5 scans laser light emitted from the laser light emitting unit on a surface of a photosensitive drum 61 at high speed, thereby exposing the surface of the photosensitive drum 61.

The developing unit 6 is detachably mounted to the body casing 2 by opening a front cover 21 mounted at a front side of the body casing 2 and has a drum unit 60 and a developing cartridge 100.

Figure 3:
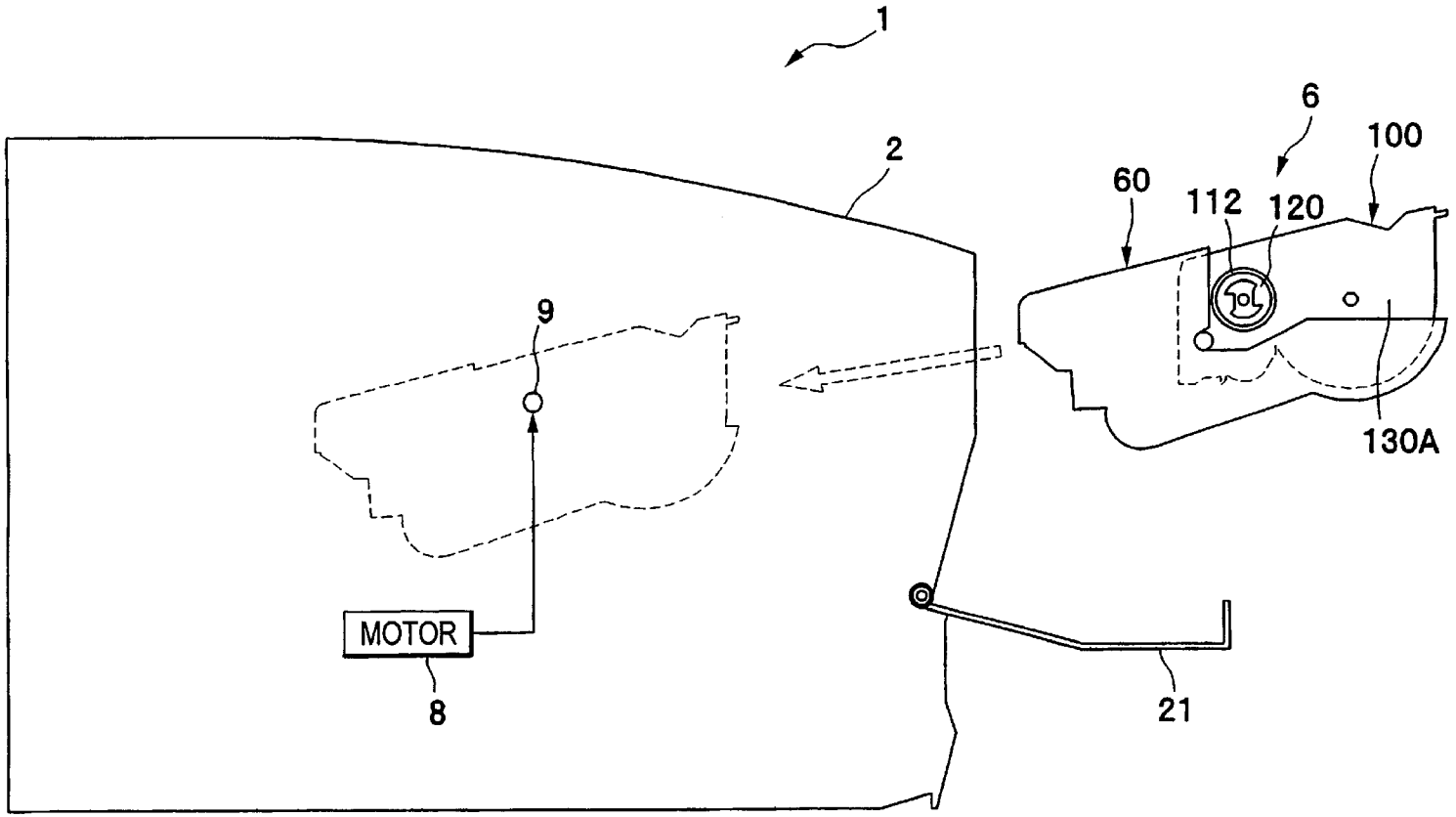
FIG. 3 shows a figure of attaching and detaching the developing cartridge to and from a body casing.

The developing cartridge 100 is detachably mounted to the drum unit 60 and is detachably mounted to the body casing 2 with being mounted to the drum unit 60 (refer to FIG. 3). The developing cartridge 100 has a developing roller 101, a layer thickness regulating blade 102, a supply roller 103, a toner accommodating unit 104 that accommodates toner, which is an example of developer, therein and an agitator 105. The detailed configuration of the developing cartridge 100 will be described below.

In the developing cartridge 100, toner in the toner accommodating unit 104 is stirred by the agitator 105 and supplied to the developing roller 101 through the supply roller 103. The toner supplied on the developing roller 101 is introduced between the layer thickness regulating blade 102 and the developing roller 101 as the developing roller 101 is rotated, and is then carried, as a thin layer having a predetermined thickness, on the developing roller 101.

The drum unit 60 has a photosensitive drum 61, a charger 62 and a transfer roller 63. In the drum unit 60, a surface of the photosensitive drum 61 is uniformly charged by the charger 62 and then exposed by the laser light from the exposure unit 5, so that an electrostatic latent image is formed on the surface of the photosensitive drum 61.

The toner carried on the developing roller 101 is supplied to the electrostatic latent image formed on the surface of the photosensitive drum 61, so that a toner image is formed on the surface of the photosensitive drum 61. Then, the sheet S is conveyed between the photosensitive drum 61 and the transfer roller 63, so that the toner image formed on the surface of the photosensitive drum 61 is transferred onto the sheet S.

The photographic fixing unit 7 has a heating roller 71 and a pressing roller 72 that is opposed to the heating roller 71 and presses the heating roller 71. In the photographic fixing unit 7, the toner image transferred on the sheet S is heat-fixed while the sheet S passes through between the heating roller 71 and the pressing roller 72. The sheet S on which the toner image is heat-fixed is discharged on a sheet discharge tray 22 by discharge rollers 73.

<Configuration for Inputting Driving Force to Developing Cartridge>

Figure 2:
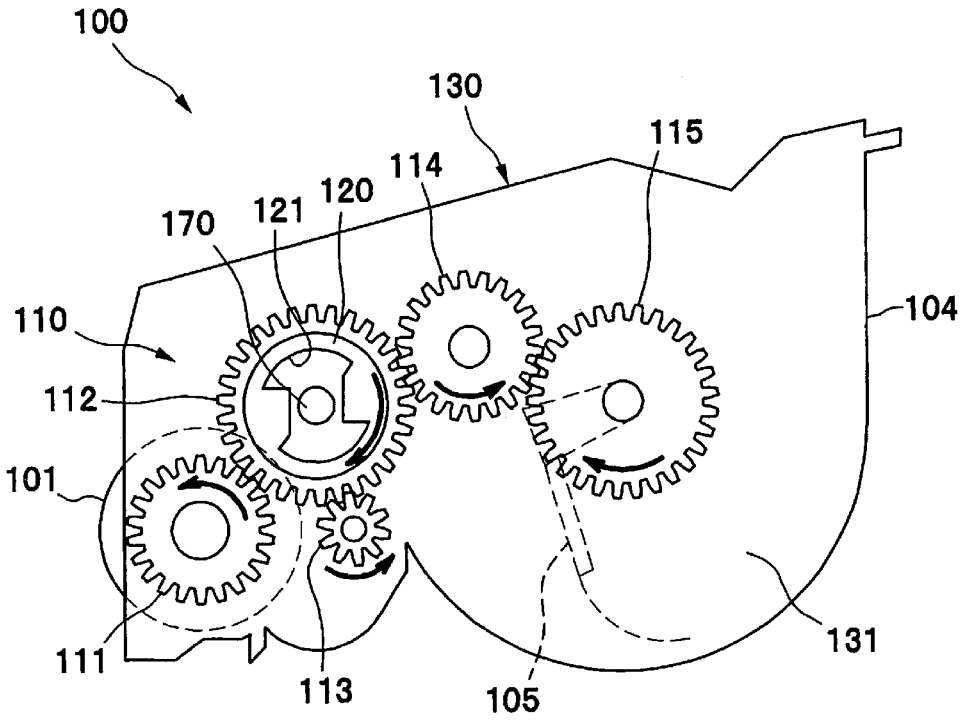
FIG. 2 is a left side view of a developing cartridge according to a first exemplary embodiment.

As shown in FIG. 2, the developing cartridge 100 has a gear mechanism 110 on a left sidewall 131 for transmitting driving force to the developing roller 101, the supply roller 103 and the agitator 105.

The gear mechanism 110 has an input gear 112, a developing roller gear 111 and a supply roller 113, which are directly engaged with the input gear 112, and an agitator gear 115 that is engaged with the input gear 112 via an intermediate gear 114. The developing roller gear 111, the supply roller gear 113 and the agitator gear 115 are respectively mounted at end portions of rotational shafts so that they are integrally rotated with the developing roller 101, the supply roller 103 and the agitator 105.

The input gear 112 is integrated with an input coupling 120 that is an example of a coupling. The input coupling 120 is configured so that it can be engaged with an outside output coupling 9, which will be described later, and transmits rotational force, which is input as the output coupling 9 is engaged, to the developing roller 101 and the like via the gear mechanism 110.

Figure 4:
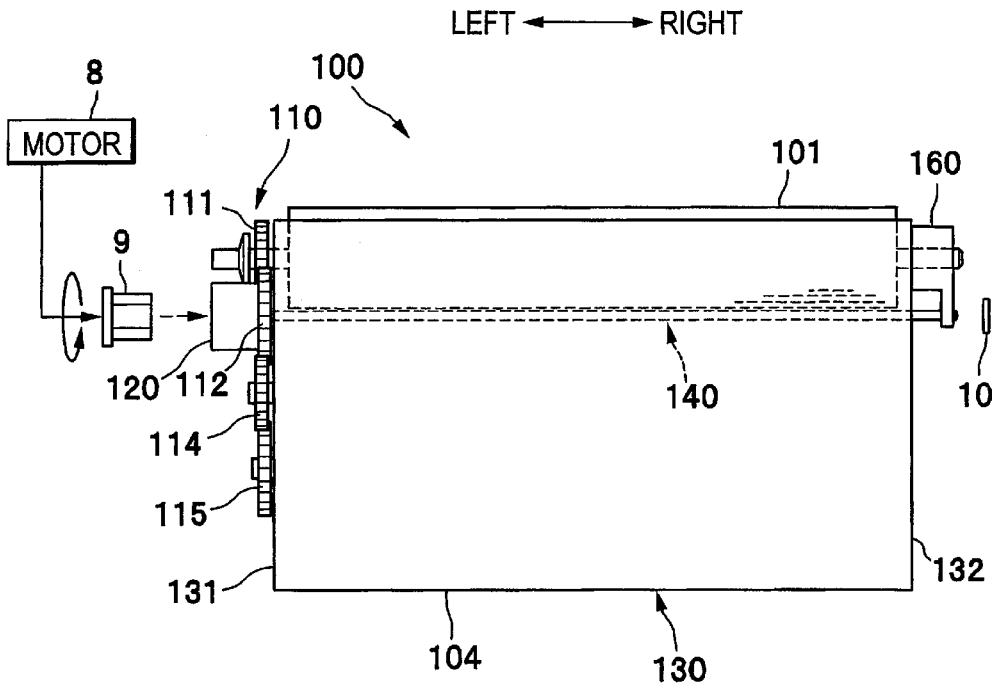
FIG. 4 is a plan view showing the developing cartridge mounted to the body casing and surrounding configurations thereof.

As shown in FIGS. 3 and 4, the laser printer 1 has in the body casing 2 a motor 8 and the output coupling 9 that is an example of a driving input part 9 to which driving force is input from the motor 8. The output coupling 9 is configured to advance and retreat in the left-right direction (a direction following a second axis line A2 that will be described later) regarding the left sidewall 131 of the developing cartridge 100 mounted in the body casing 2, as the front cover 21 is opened and closed.

The output coupling 9 is engaged to the input coupling 120 of the developing cartridge 100 and is rotated in a clockwise direction of FIG. 2, so that the input gear 112 is rotated and thus the developing roller gear 111, the supply roller gear 113 and the agitator gear 115 are respectively rotated. Thereby, the developing roller 101, the supply roller 103 and the agitator 105 are rotated in predetermined directions.

In the meantime, the gear mechanism 110 mounted on the left sidewall 131 of the developing cartridge 100 is covered by a gear cover 130A (refer to FIG. 3), except for parts that are required to be exposed.

<Detailed Configurations of Developing Cartridge>

As shown in FIG. 4, the developing cartridge 100 has a housing 130, the developing roller 101, the input coupling 120, a moving member 140, a coil spring 150, (refer to FIG. 5) which is an example of a press member, and a conductive member 160, which is an example of a first engagement part.

The housing 130 is a member that forms the toner accommodating unit 104 in which toner is accommodated and supports the developing roller 101 and the like, and has the left sidewall 131, which is an example of a first sidewall, and a right sidewall 132, which is an example of a second sidewall, such that the sidewalls face each other in the left-right direction.

Figure 5:
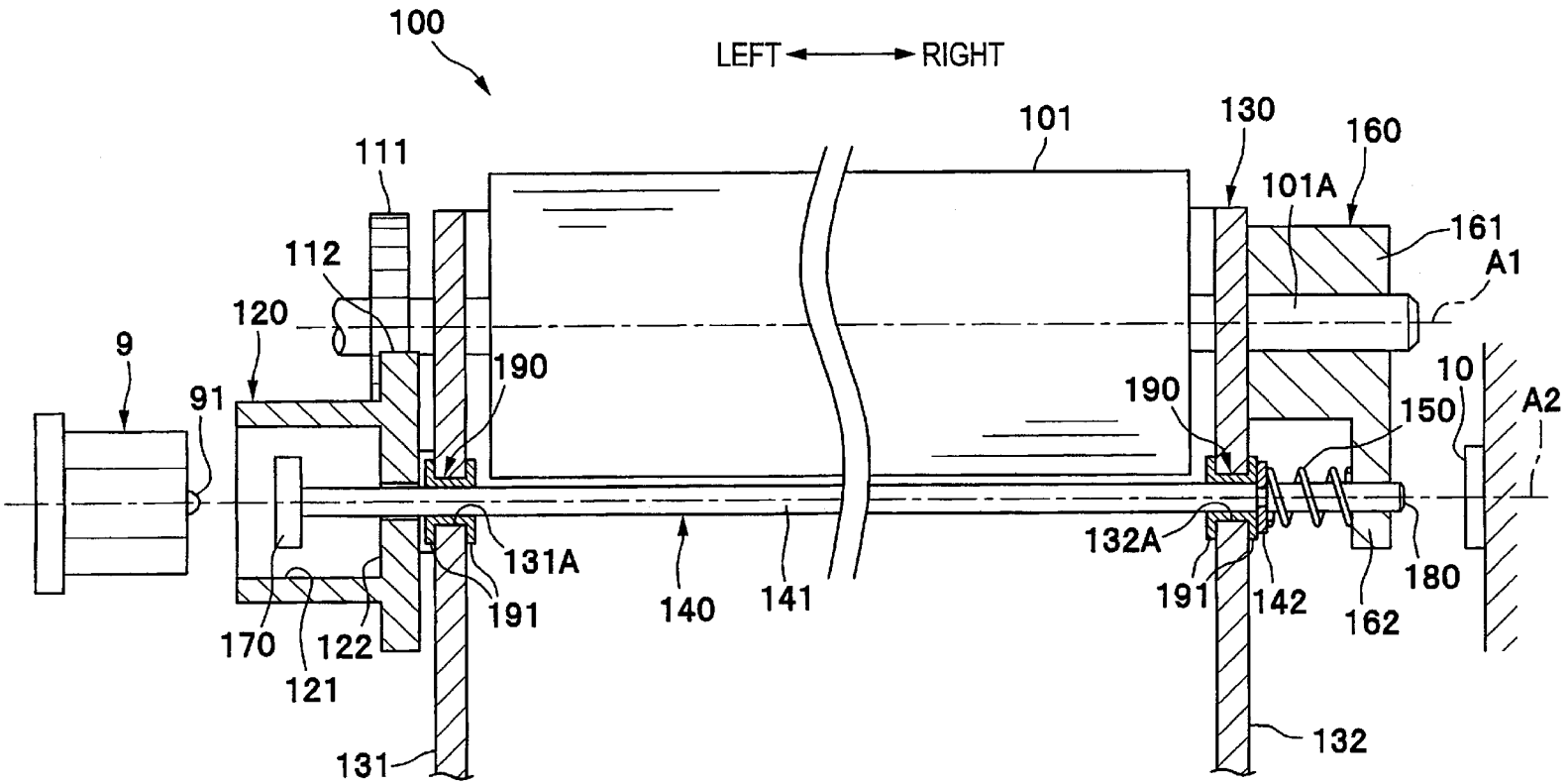
FIG. 5 is an enlarged sectional view showing a configuration of the developing cartridge according to the first exemplary embodiment.

As shown in FIG. 5, the developing roller 101 is supported at the left sidewall 131 and the right sidewall 132 and is rotatable about a rotational shaft 101A (first axis line A1). A left end portion of the rotational shaft 101A protrudes from the left sidewall 131 and the developing roller gear 111 is mounted thereto so that it is integrally rotated. In addition, a right end portion of the rotational shaft 101A protrudes from the right sidewall 132 and is rotatably inserted into and is electrically connected to the conductive member 160.

The input coupling 120 is mounted on the left sidewall 131 and is configured to rotate about a second axis line A2 parallel with the first axis line A1. The input coupling 120 has an engagement recess 121 that is an example of an engagement part to which the output coupling 9 mounted in the body casing 2 is engaged.

The moving member 140 is a member that connects the left sidewall 131 and the right sidewall 132 and has an extension member 141, a pushing part 170 and an electrode part 180.

The extension member 141 is a rod-shaped member having conductivity and is inserted into through-holes 131A, 132A formed on the left sidewall 131 and the right sidewall 132, so that it is movably supported to the housing 130 along the advancing and retreating direction (left-right direction) of the output coupling 9.

Seal members 190 for suppressing toner leakage from the inside of the housing 130 are interposed between the extension member 141 and inner circumferential surfaces of the through-holes 131A, 132A. The seal member 190 has a cylindrical shape and a pair of flange parts 191 that is mounted to sandwich the left sidewall 131 or right sidewall 132 at both end portions (left and right end portions) thereof regarding the extending direction of the moving member 140.

Even when the moving member 140 is moved leftward and rightward, the seal members 190 are not well dropped out of the through-holes 131A, 132A, so that the toner leakage from the inside of the housing 130 can be securely suppressed.

The extension member 141 is arranged along the second axis line A2 and has a left end that protrudes from the left sidewall 131 and penetrates the input gear 112 and the input coupling 120 (a bottom 122 of the engagement recess 121).

The pushing part 170 is a part that is pushed toward the right sidewall 132 by pushing force of the output coupling 9 engaged with the input coupling 120 and is integrated with the end portion (left end portion) of the extension member 141 at the left sidewall 131. The pushing part 170 has a substantially disc shape having a diameter larger than the extension member 141 of the moving member 140. Thereby, the left end portion of the moving member 140 has a T shape when seen from a plan view.

In the meantime, the output coupling 9 mounted in the body casing 2 has, at a surface facing a left surface of the pushing part 170, a protrusion 91 that protrudes toward the pushing part 170. The protrusion 91 has such a shape that is tapered toward a leading end portion thereof, in this exemplary embodiment, a substantially hemispherical shape. The protrusion 91 is contacted to the pushing part 170 when the pushing part 170 is pushed toward the right sidewall 132 (refer to FIG. 6).

Figure 6:
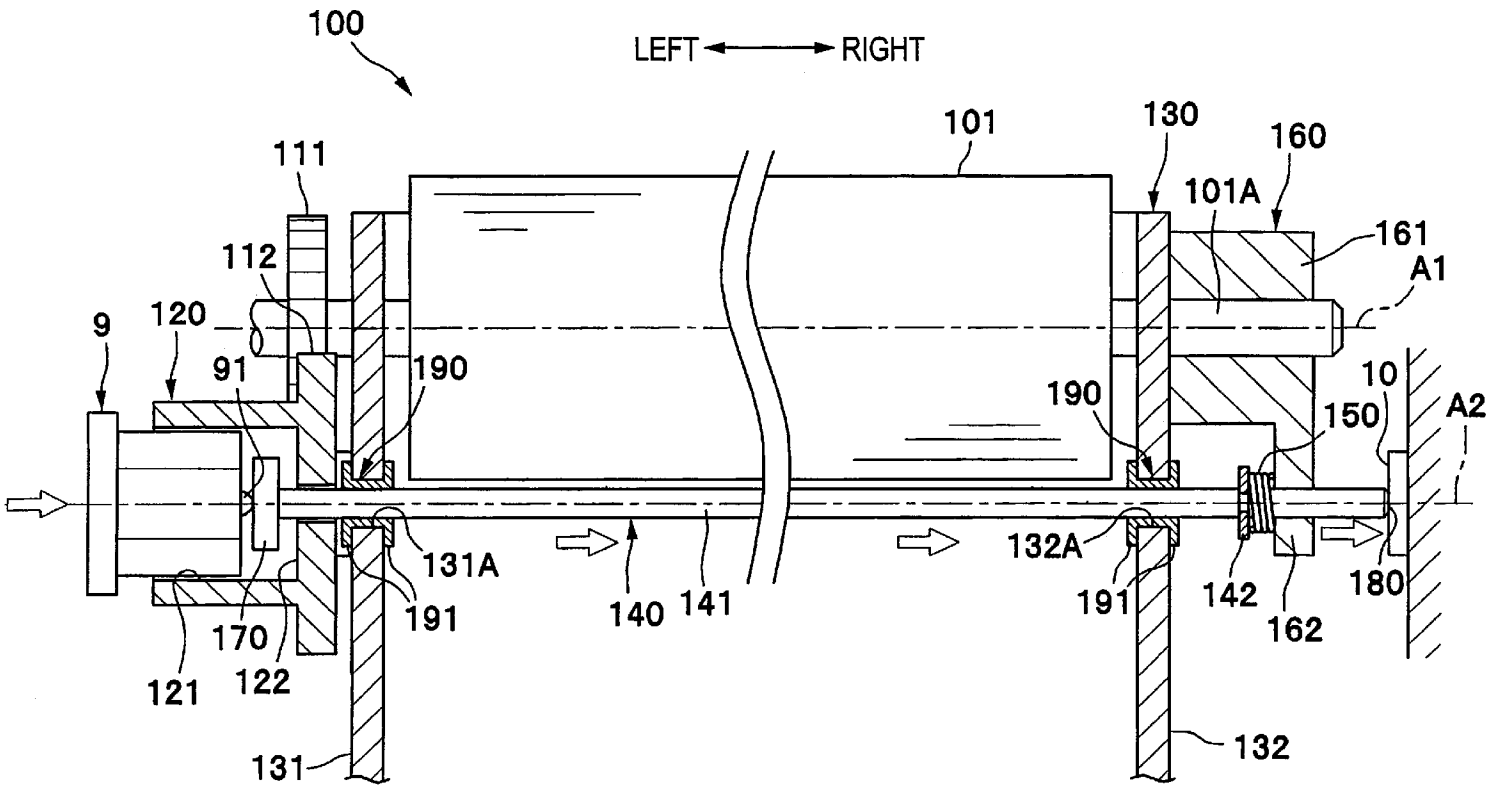
FIG. 6 illustrates an operation of the developing cartridge according to the first exemplary embodiment.

As shown in FIG. 5, before the output coupling 9 is engaged with the engagement recess 121, the pushing part 170 protrudes more leftward from the bottom 122 of the engagement recess 121 than when the output coupling 9 is engaged with the engagement recess 121, as shown in FIG. 6.

The electrode part 180 is a part for applying a developing bias to the developing roller 101. In this exemplary embodiment, an end portion (right end portion) of the moving member 140 (conductive extension member 141) at the right sidewall 132 forms the electrode part 180.

As described below, after the developing cartridge 100 is mounted to the body casing 2, the electrode part 180 contacts an apparatus-side electrode 10 mounted in the body casing 2 and supplies current, which is supplied from the apparatus-side electrode 10, to the developing roller 101 (rotational shaft 101A) through the conductive member 160.

The electrode part 180 (moving member 140) protrudes from the right sidewall 132 and is inserted into the conductive member 160 before the pushing part 170 is pushed. At this time, the moving member 140 is adapted to move in the left-right direction regarding the conductive member 160 while electrically contacting the conductive member 160. In this exemplary embodiment, the right end portion (electrode part 180) of the moving member 140 protrudes slightly from the conductive member 160 before the pushing part 170 is pushed.

The conductive member 160 is a member that is mounted to extend to the outside of the right sidewall 132 and electrically connects the developing roller 101 and the electrode part 180, and is made of a conductive resin and the like, for example. The conductive member 160 has a fixing part 161 that is fixed to the right sidewall 132 and into which the rotational shaft 101A of the developing roller 101 is inserted and an extension 162 that extends from a right end of the fixing part 161 and into which the electrode part 180 (moving member 140) is inserted. The right sidewall 132 and the extension 162 are arranged at an interval in the left-right direction and the extension 162 (conductive member 160) is engaged with a right end (one end) of the coil spring 150.

The moving member 140 has a second engagement part 142 that is arranged between the right sidewall 132 and the extension 162 (conductive member 160) and engaged to a left end (the other end) of the coil spring 150. The second engagement part 142 may be formed by engaging an E ring and the like in a recess formed on a circumference of the extension member 141.

The coil spring 150 is a member that presses the moving member 140 toward the left sidewall 131 from the right sidewall 132 and is compressed between the conductive member 160 and the second engagement part 142 with being inserted into the extension member 141. By mounting the coil spring 150, the moving member 140 can be always pressed leftward. Accordingly, before the output coupling 9 is engaged, the pushing part 170 can protrude further from the bottom 122 of the engagement recess 121 than after the output coupling 9 has been engaged (refer to FIG. 6).

In addition, the moving member 140 is always pressed leftward by the coil spring 150, so that the protruding of the electrode part 180 from the housing 130 (conductive member 160) can be made to be small. Thereby, it is possible to suppress the electrode part 180 from being damaged or broken when handling the developing cartridge 100. In addition, when attaching and detaching the developing cartridge 100 to and from the body casing 2, the electrode part 180 is difficult to slidingly contact the apparatus-side electrode 10, so that it is possible to suppress the wear of the apparatus-side electrode 10.

<Operations of Developing Cartridge>

Operations of the developing cartridge 100 will now be described below.

When the developing cartridge 100 is mounted to the body casing 2 and the front cover 21 is closed, for example, the output coupling 9 is moved toward the developing cartridge 100 and is engaged to the input coupling 120 (engagement recess 121), as shown in FIG. 4.

Then, as shown in FIG. 6, the protrusion 91 of the output coupling 9 is contacted to the pushing part 170 and the output coupling 9 is further moved toward the right sidewall 132, so that the pushing part 170 is pushed by the output coupling 9. Thereby, the moving member 140 is wholly moved toward the right sidewall 132, so that the electrode part 80 protrudes from the right sidewall 132 more (conductive member 160) than before the pushing part 170 is pushed (refer to FIG. 5).

Finally, the electrode part 180 is contacted to the apparatus-side electrode 10, so that developing bias can be applied to the developing roller 101.

In the meantime, when the front cover 21 is opened, for example, the output coupling 9 is moved in a direction away from the developing cartridge 100, so that the output coupling 9 is separated from the input coupling 120 (engagement recess 121).

Thereby, since the pushing part 170 is not applied with the pushing force from the output coupling 9, the moving member 140 is entirely moved to the left sidewall 131 by restoring force of the coil spring 150 (refer to FIG. 5). As a result, the electrode part 180 is separated from the apparatus-side electrode 10 and is returned to its original position at which the protrusion from the housing 130 thereof (conductive member 160) is small.

As described above, following effects may be realized according to the exemplary embodiment.

Since the pushing part 170 is pushed by the output coupling 9 and thus the electrode part 180 protrudes from the housing 130 more than before the pushing part 10 is pushed, it is possible to make the protruding of the electrode part 180 from the housing 130 small before the mounting.

Thereby, since it is possible to suppress the electrode part 180 from being damaged when handling the developing cartridge 100 such as when conveying or attaching/detaching the developing cartridge, it is possible to protect the electrode part 180. In addition, when attaching and detaching the developing cartridge 100 to and from the body casing 2, the electrode part 180 is difficult to slidingly contact the apparatus-side electrode 10. Therefore, it is possible to suppress the wear of the apparatus-side electrode 10, so that it is possible to protect the apparatus-side electrode 10.

In addition, since the pushing part 170 protrudes from the bottom 122 of the engagement recess 121 more before the output coupling 9 is engaged than after the output coupling 9 is engaged, it is possible to securely push the pushing part 170 into engagement of the output coupling 9.

Particularly, in this exemplary embodiment, since the moving member 140 is mounted to penetrate the input coupling 120, it is possible to push the pushing part 170 more securely, compared to a configuration in which the pushing part provided at the outside of the input coupling 120 (engagement recess 121) is pushed by the output coupling 9.

Further, since the output coupling 9 has the protrusion 91 at the surface facing the pushing part 170 and the protrusion 91 is contacted to the pushing part 170 when pushing the pushing part 170 toward the right sidewall 132, it is possible to make the contact area between the output coupling 9 and the moving member 140 small. Thereby, since it is possible to favorably rotate the output coupling 9, it is also possible to favorably rotate the developing roller 101 and the like.

Particularly, in this exemplary embodiment, since the pushing part 170 has the shape having the diameter larger than another part (extension member 141) of the moving member 140, it is possible to securely contact the output coupling 9 to the moving member 140 (pushing part 170) while making the contact area between the output coupling 9 and the moving member 140 small. Thereby, it is possible to securely push the pushing part 170.

Second Exemplary Embodiment

Next, a second exemplary embodiment of the invention will be described. In the following exemplary embodiment, the elements similar to those discussed in the above exemplary embodiment will be indicated with the same reference numerals and the descriptions thereof will be omitted.

Figure 7A:
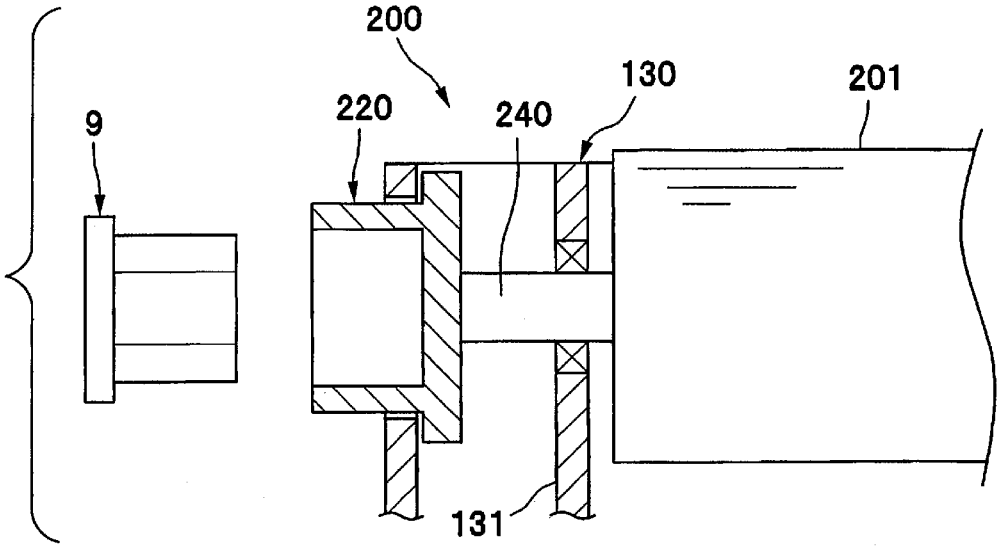

As shown in FIG. 7A, a developing cartridge 200 of this exemplary embodiment includes a developing roller 201, which has a rotational shaft 240, which is used as the moving member. An input coupling 220 (coupling) is integrated with a left end portion of the rotational shaft 240 (moving member). In addition, the rotational shaft 240 (developing roller 201) is supported by the left sidewall 131 (housing 130) so that it can be moved along the advancing and retreating direction (left-right direction) of the output coupling 9.

Figure 7B:
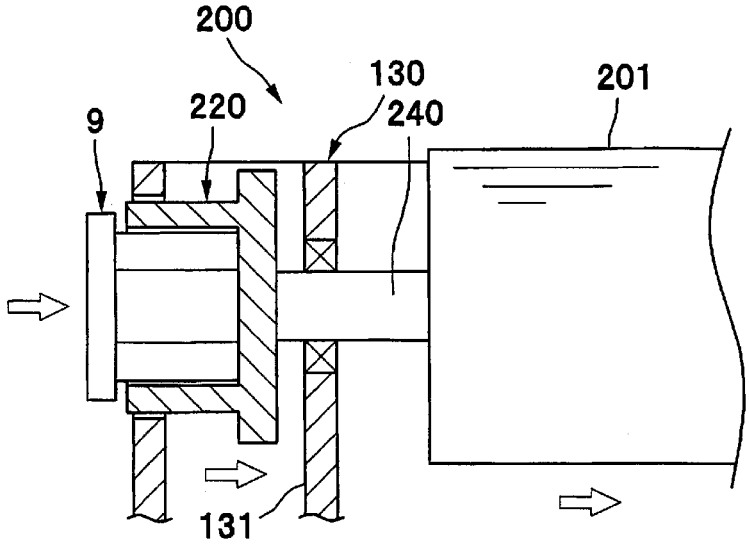

In the developing cartridge 200, the output coupling 9 is engaged with the input coupling 220 and the input coupling 220 is pushed by the output coupling 9, as shown in FIG. 7B, so that the rotational shaft 240 (moving member) is moved toward the right sidewall 132, which is not shown.

According to this exemplary embodiment, since the input coupling 220 is integrated with the rotational shaft 240 (moving member), it is not necessary to separately provide the pushing part and thus a configuration of the developing cartridge 200 is simplified.

In addition, since the rotational shaft 240 of the developing roller 201 is used as the moving member, it is not necessary to provide the moving member 140, the through-holes 131A, 132A, the seal members 190 and the like, which are provided in the first exemplary embodiment. Further, although not shown, since a right end portion (electrode part) of the rotational shaft 240 can be directly contacted to the apparatus-side electrode, the conductive member 160 of the first exemplary embodiment is not required. Also by these configurations, it is possible to simplify the configuration of the developing cartridge 200.

Third Exemplary Embodiment

In the followings, a third exemplary embodiment of the invention will be described.

Figure 8A:
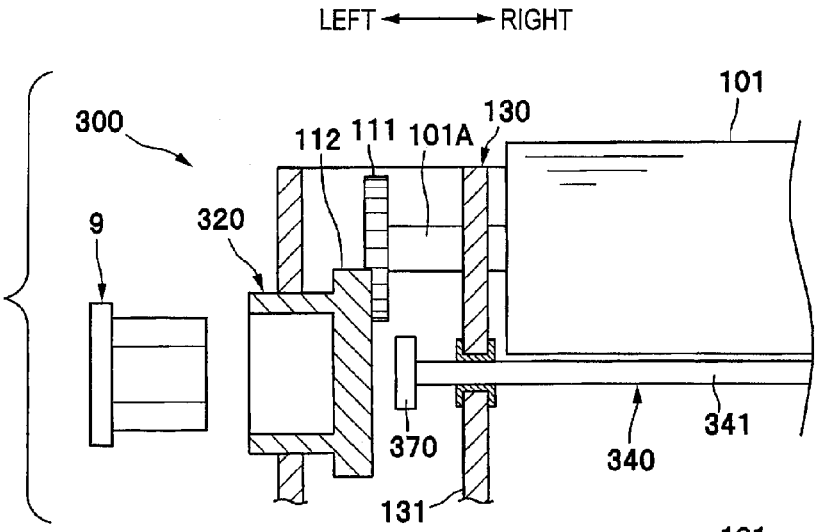

As shown in FIG. 8A, a developing cartridge 300 of this exemplary embodiment has an input coupling 320 and a moving member 340, which are separately mounted and are arranged on substantially the same axis line.

The moving member 340 has an extension member 341, a pushing part 370 and an electrode part that is not shown, and is supported by the housing 130 so that it can be moved along the left-right direction.

The input coupling 320 is integrated with the input gear 112 that is directly engaged with the developing roller gear 111, and is arranged at the left side of the pushing part 370 with being spaced from the moving member 340 before the output coupling 9 is engaged. The input coupling 320 is mounted to the left sidewall 131 (housing 130) so that it can be moved along the advancing and retreating direction (left-right direction) of the output coupling 9.

Figure 8B:
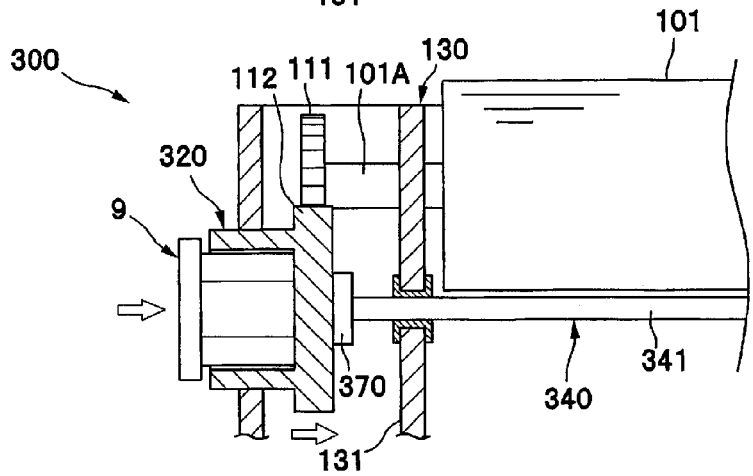

In the developing cartridge 300, as shown in FIG. 8B, when the output coupling 9 is engaged to the input coupling 320, the input coupling 320 is pushed by the output coupling 9 and thus moved toward the right sidewall 132, which is not shown, and is contacted to the pushing part 370 of the moving member 340.

Figure 8C:
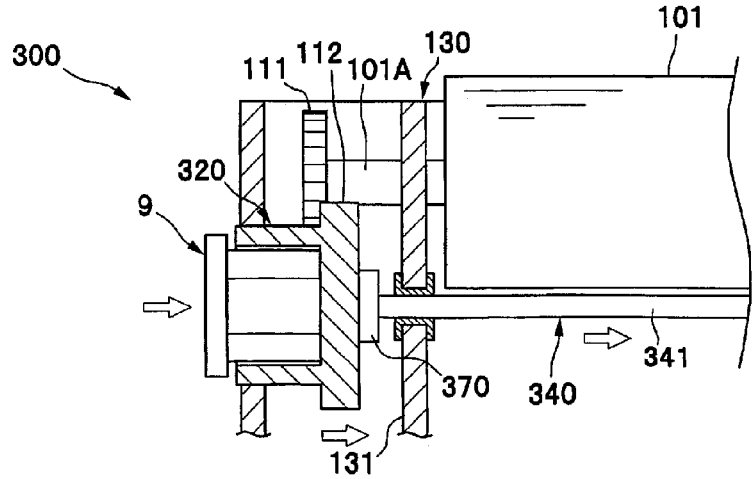

Then, as shown in FIG. 8C, the input coupling 320 is pushed by the pushing force of the output coupling 9, so that the moving member 340 is moved toward the right sidewall 132 (not shown) integrally with the input coupling 320.

Like this, according to the invention, the member (for example, input coupling 320) different from the moving member 340 may be interposed between the output coupling 9 (driving input part) and the moving member 340 inasmuch as the pushing force from the output coupling 9 (driving input part) is transmitted to the moving member 340.

In the meantime, in order to make the contact area between the moving member 340 and the input coupling 320 being rotated small, a protrusion that protrudes toward the pushing part 370 may be provided on a surface facing the pushing part 370 of the input coupling 320.

Fourth Exemplary Embodiment

In the followings, a fourth exemplary embodiment of the invention will be described.

Figure 9A:
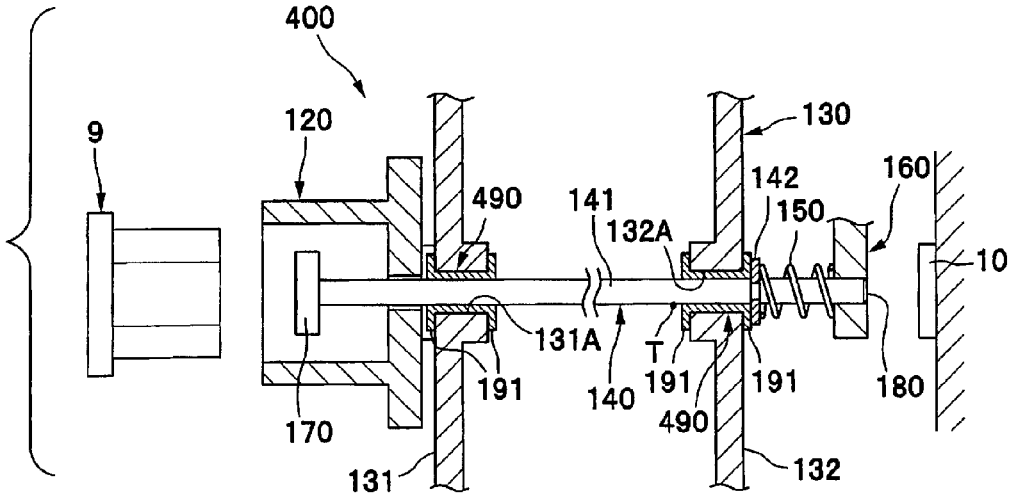
Figure 9B:
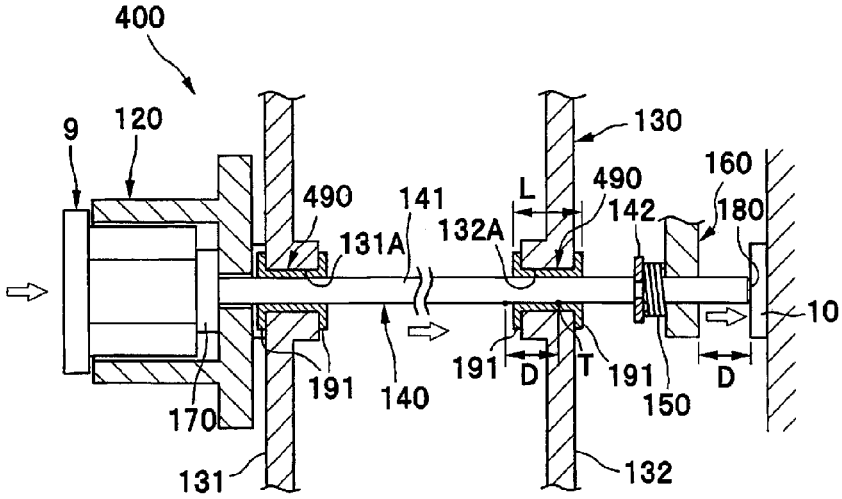

As shown in FIGS. 9A and 9B, according to a developing cartridge 400 of this exemplary embodiment, seal members 490 are provided between the extension member 141 of the moving member 140 and the inner circumferential surfaces of the through-holes 131A, 132A into which the extension member 141 is inserted.

The seal member 490 has a cylindrical shape and a pair of flange parts 191 that are mounted to sandwich the left sidewall 131 or right sidewall 132 at both left and right end portions thereof. The seal members 191 are configured in such a way that a length L regarding the extending direction (left-right direction) of the extension member 140 is larger than a moving distance D when the moving member 140 is moved toward the right sidewall 132.

Due to the seal members 490, the toner T does not leaked to the outside through the through-hole 132A even when before the pushing part 170 is pushed toner T attached to the extension member 141 (adjacent to the right sidewall 132) is introduced between the extension member 141 and the seal member 490 as the moving member 140 is moved.

Specifically, as the moving member 140 is moved, the toner T attached to the extension member 141 is displaced rightward by the moving distance D of the moving member 140. However, since the length L of the seal member 490 is larger than the moving distance D, the toner stays between the extension member 141 and the seal member 490.

Similarly, according to this exemplary embodiment, it is possible to suppress the toner leakage from the inside of the housing 130 more reliably. In addition, since the seal members 490 of this exemplary embodiment have the flange parts 191, like the seal members 190 of the first exemplary embodiment, the seal members are not well dropped out of the through-holes 131A, 132A.

Fifth Exemplary Embodiment

A fifth exemplary embodiment of the invention will be described below.

Figure 10A:
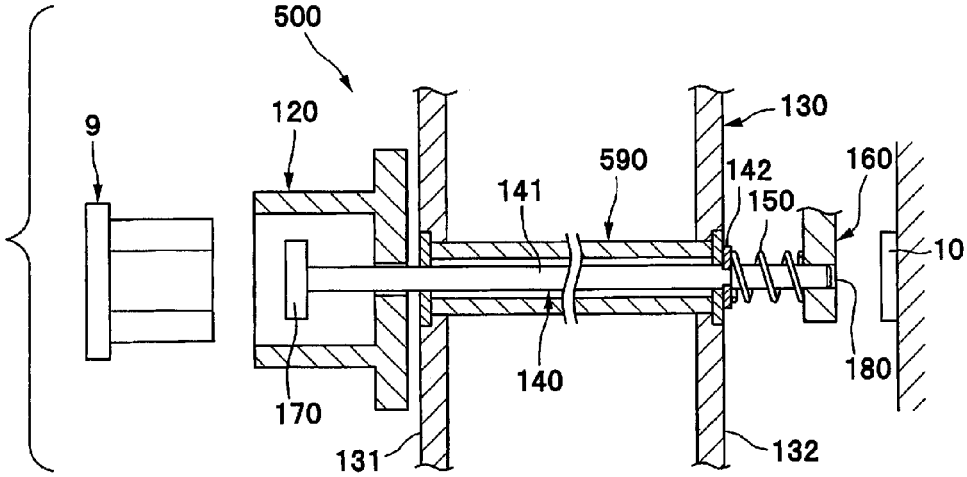
Figure 10B:
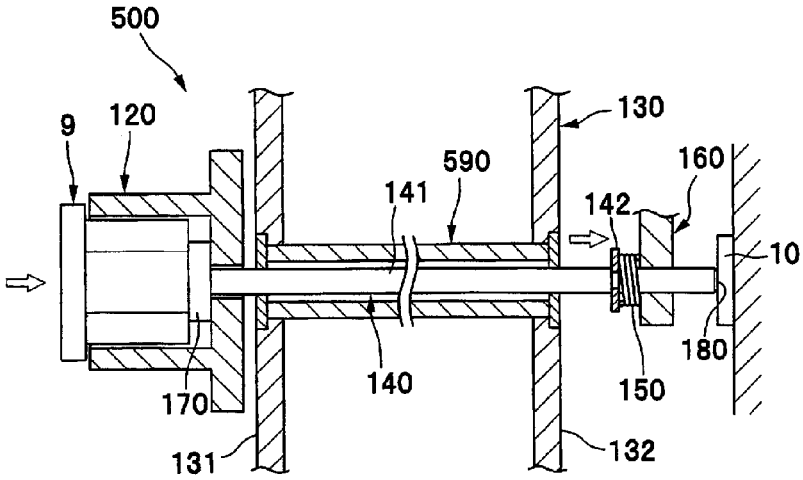

As shown in FIGS. 10A and 10B, according to a developing cartridge 500 of this exemplary embodiment, the housing 130 has a cylinder-shaped member 590 that is mounted from the left sidewall 131 to the right sidewall 132 and the moving member 140 is inserted into the cylinder-shaped member 590 and is supported so that it can be moved along the advancing and retreating direction (left-right direction) of the output coupling 9.

According to this configuration, it is possible to completely separate a space in which the moving member 140 moving along the left-right direction is arranged and a space in which toner exists. Therefore, it is possible to securely suppress the toner leakage from the inside of the housing 130 without the seal members 190, 490 and the like of the above exemplary embodiments.

The shape of the cylinder-shaped member 590 is not particularly limited and may be cylindrical or polygonal. In addition, the moving member 140 may be inserted with being closely contacted so that it can be moved in the cylinder-shaped member 590, or may be inserted with a play into the cylinder-shaped member 590.

Although various exemplary embodiments have been described, the invention is not limited to the above exemplary embodiments. For example the specific configurations may be appropriately changed without departing from the spirit of the invention.

In the first exemplary embodiment, the moving member 140 was integrated with the pushing part 170 and the electrode part 180, i.e., one moving member 140 has been described. However, the invention is not limited thereto. For example, the moving member of the invention may be configured with two or more members.

Figure 11A:
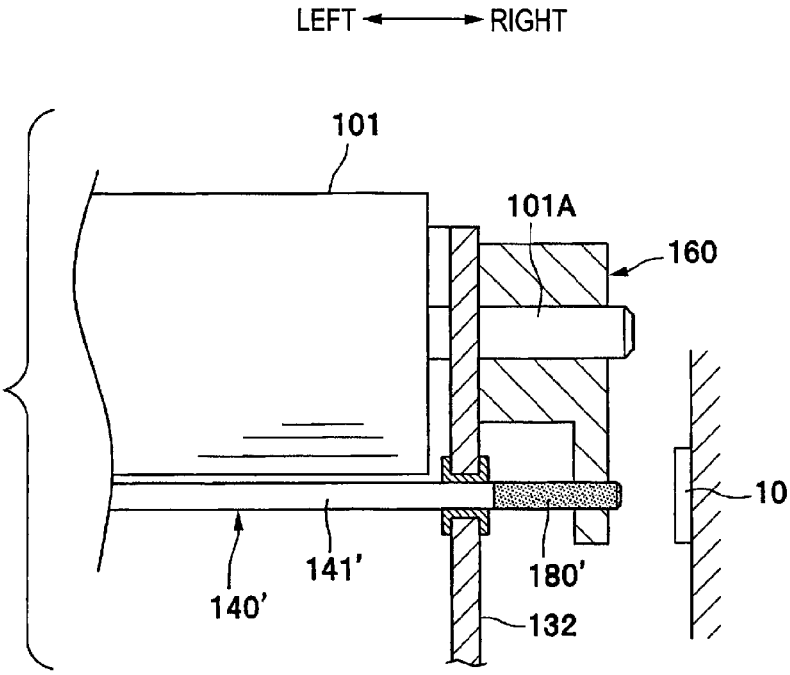
Figure 11B:
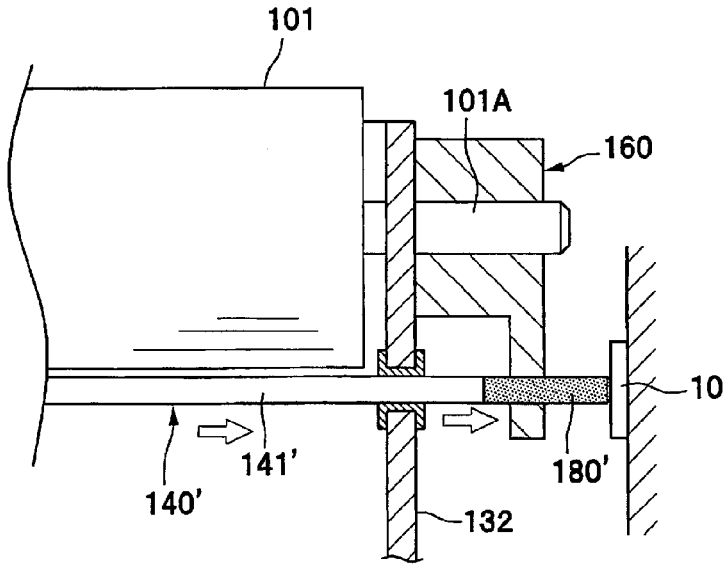

Specifically, as shown in FIGS. 11A and 11B, for example, a moving member 140' may have a rod-shaped extension member 141' made of an insulating resin and the like and an electrode part 180' (metal rod or metal plate) that is made of a member different from the extension member 141' and is fixed to a right end portion of the extension member 141'. In addition, the extension member 141' may be configured by a plurality of short rod-shaped members, each of which is connected to each other.

Figure 12A:
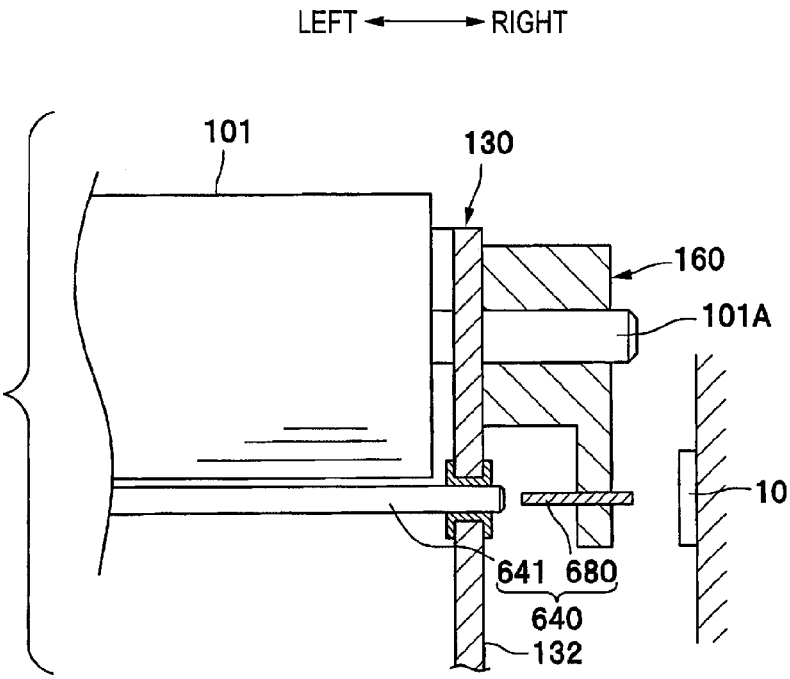
Figure 12B:
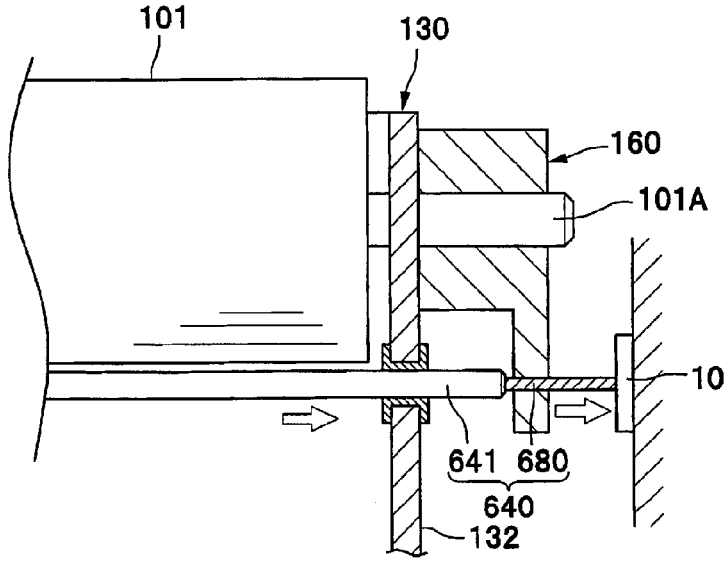

In the meantime, the electrode part that is a different member may not be fixed to the extension member. For example, as shown in FIG. 12A, an extension member 641 and an electrode plate 680 that is an example of the electrode part, which forms a moving member 640, may be spaced from each other before the pushing part is pushed. In this exemplary embodiment, when the pushing part is pushed by the pushing force of the output coupling 9 (not shown) and the extension member 641 is thus moved toward the right sidewall 132, the extension member 641 is contacted to the electrode plate 680. Then, as shown in FIG. 12B, the extension member 641 and the electrode plate 680 are integrally moved, so that the electrode plate 680 is contacted to the apparatus-side electrode 10.

Although not shown, the pushing part may be also configured in the same method as the electrode part.

In the above exemplary embodiments, the coil spring 150 has been exemplified as the press member. However, the invention is not limited thereto. For example, a pulling spring or plate spring may be adopted. Alternatively, a member having elasticity such as a foam elastic member may be adopted.

Figure 13A:
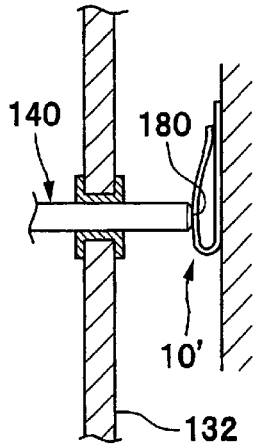
Figure 13B:
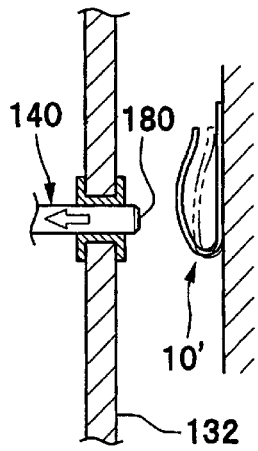

In addition, the developing cartridge may not have the press member. In this case, the main body of the image forming apparatus may be provided with a member that presses the moving member from the second sidewall toward the first sidewall. Specifically, as shown in FIGS. 13A and 13B, an apparatus-side electrode 10' may be configured to serve as a plate spring. According to this configuration, as the pushing of the drive input part is released, the moving member 140 may be pressed from the second sidewall to the first sidewall by the restoring force of the apparatus-side electrode 10' (plate spring).

In the first exemplary embodiment, the moving member 140 is configured to penetrate the input coupling 120 (coupling). However, the invention is not limited thereto. For example, the moving member (pushing part) may be arranged at the outside of the input coupling 120.

In the above exemplary embodiments, the engagement recess 121 has been exemplified as the engagement part of the coupling. However, the invention is not limited thereto. For example, a convex engagement part that is engaged with the drive input part may also be possible. In addition, regarding the configuration in which the protrusion engaged with the drive input part is provided on the surface, the surface having the protrusion may be configured as the engagement part.

Figure 14A:
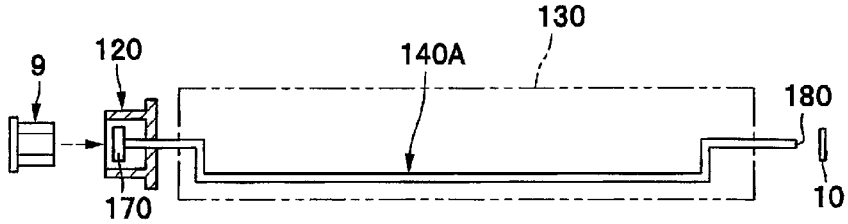
FIGS. 14A to 14D show configurations of moving m¥embers according to modified embodiments.

In the first exemplary embodiment, the rod-shaped straight moving member 140 extending in a direction following the second axis line A2 has been shown. However, the invention is not limited thereto. For example, as shown in FIG. 14A, a moving member 140A having a substantially U shape may be arranged in the housing 130. According to this configuration, it is possible to provide the moving member 140A while avoiding the members in the housing 130.

Figure 14B:
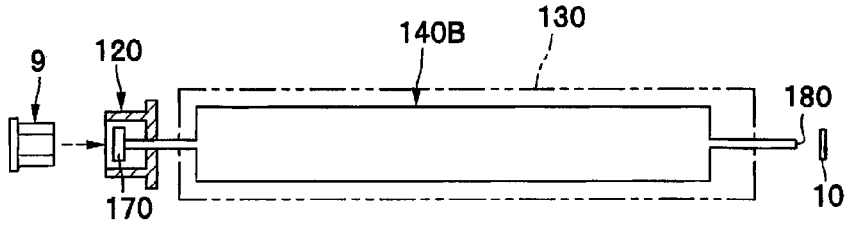

In addition, as shown in FIG. 14B, a part of a moving member 140B may have a plate shape. According to this configuration, since the part having a plate shape can be used as a wall dividing a part in which the developing roller, the supply roller and the like are provided and a part in which toner is accommodated, it is possible to make the developing cartridge smaller.

Figure 14C:
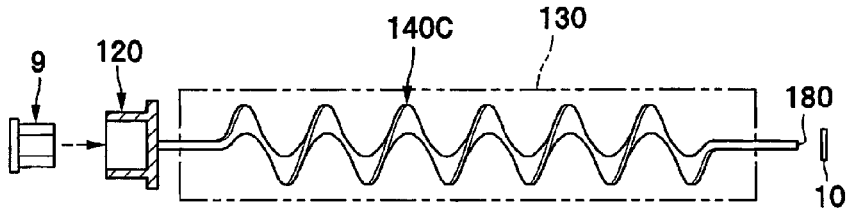

Additionally, as shown in FIG. 14C, a moving member 140C having a spiral shape may be arranged in the housing 130. According to this configuration, the moving member 140C can be configured to rotate by providing the input coupling 120 to a left end portion of the moving member, for example, so that the moving member can be made to serve as an auger stirring and conveying toner in the housing 130.

Figure 14D:
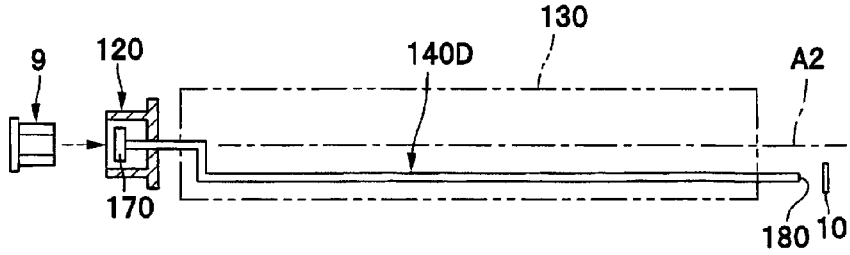

Further, as shown in FIG. 14D, a moving member 140D may be arranged in such as way that the pushing part 170 and the electrode part 180 are inconsistent with each other when seen from the advancing and retreating direction of the output coupling 9. According to this configuration, the invention can be applied to an image forming apparatus in which the apparatus-side electrode 10 is not provided on the second axis line A2. In addition, when designing an image forming apparatus, it is possible to increase a degree of arrangement freedom of the output coupling 9 and the apparatus-side electrode 10. Therefore, it is possible to make an image forming apparatus small.

In the first exemplary embodiment, the conductive member 160 has been shown as the first engagement part. However, the invention is not limited thereto. For example, the first engagement part may be provided separately from the conductive member 160. Additionally, in the above exemplary embodiments, the second engagement part 142 has been formed by engaging the E ring and the like in the recess of the extension member 141. However, the invention is not limited thereto. For example, the second engagement part (protrusion and the like) may be directly formed at the moving member (extension member 141).

In the above exemplary embodiments, the moving member 140 extends in the housing 130 so that it connects the left sidewall 131 (first sidewall) and the right sidewall 132 (second sidewall). However, the invention is not limited thereto. For example, the moving member may extend at the outside of the housing (a part in which developer is accommodated) so that it connects the first sidewall and the second sidewall.

In the first exemplary embodiment, the protrusion 91 provided to the output coupling 9 (drive input part) has a substantially hemispherical shape. However, the shape of the protrusion is not particularly limited inasmuch as it is tapered toward the leading end thereof. For example, the protrusion may have a substantially triangular shape.

In the above exemplary embodiments, the input coupling 120 and the output coupling 9 have been shown as the coupling and the drive input part, respectively. However, the invention is not limited thereto. For example, the coupling and the drive input part may have other configurations without departing from the scope of the invention.

In the above exemplary embodiments, the left sidewall 131 and the right sidewall 132 have been shown as the first sidewall and the second sidewall, respectively. However, the invention is not limited thereto. For example, the left and the right of the first sidewall and the second sidewall may be opposite to the exemplary embodiments.

In the first exemplary embodiment, the right end portion (electrode part 180) of the moving member 140 slightly protrudes from the conductive member 160 (outer surface of the developing cartridge) before the pushing part 170 is pushed. However, the invention is not limited thereto. For example, as shown in FIG. 9A, the right end portion (electrode part 180) of the moving member 140 may be flush with a right end face of the conductive member 160 (outer surface of the developing cartridge) before the pushing part 170 is pushed. In addition, as shown in FIG. 10A, the right end portion (electrode part 180) of the moving member 140 may be inserted into the right end face of the conductive member 160 (outer surface of the developing cartridge) before the pushing part 170 is pushed.

In the above exemplary embodiments, the developing cartridge 100 that is detachably mounted to the drum unit 60 has been shown. However, the invention is not limited thereto. For example, the developing cartridge of the invention may be a cartridge in which the drum unit 60 and the developing cartridge 100 of the first exemplary embodiment are undetachably integrated.

In the above exemplary embodiments, the black-white laser printer 1 has been shown as the image forming apparatus. However, the invention is not limited thereto. For example, a color printer is also possible. In addition, the image forming apparatus is not limited to the printer and may be a copier or complex machine.

What is claimed is:

1. A developing cartridge comprising:

a housing configured to accommodate developer therein, the housing including:

a first sidewall and a second sidewall opposed to the first sidewall;

a developing roller received by the first sidewall and the second sidewall, and configured to rotate about a first axis line;

a coupling disposed at the first sidewall and configured to rotate about a second axis line parallel with the first axis line, the coupling configured to transfer rotational force to the developing roller; and a moving member received by the first sidewall and the second sidewall and extending along the second axis line, the moving member configured to move between the first side wall and the second side wall along the second axis line, wherein the moving member includes:

a first part being disposed at one end of the moving member along the second axis line, and a second part being disposed at an other end of the moving member along the second axis line, the second part configured to be electrically connected to the developing roller, and the second part configured to protrude from the second sidewall based on moving of the moving member.

2. The developing cartridge according to claim 1, further comprising a press member configured to press the moving member from the second sidewall to the first sidewall, wherein the coupling is disposed on an outer surface of the first sidewall, wherein the moving member is configured to move from the second sidewall to the first sidewall along the second axis line based on pressing of the pressing member, and wherein the first part is configured to protrude from the coupling based on moving of the moving member from the second sidewall to the first sidewall along the second axis line.

3. The developing cartridge according to claim 2, further comprising a first engagement part disposed so as to extend to the outside of the second sidewall and engaged with one end of the press member, wherein the moving member includes a second engagement part that is disposed between the second sidewall and the first engagement part and is engaged with the other end of the press member, and wherein the press member is disposed with being compressed between the first engagement part and the second engagement part.

4. The developing cartridge according to claim 1, wherein the moving member is mounted to penetrate the coupling.

5. The developing cartridge according to claim 1, wherein the coupling is integrated with the moving member.

6. The developing cartridge according to claim 1, wherein the moving member is formed by two or more members.

7. The developing cartridge according to claim 1, wherein the moving member is inserted into a through-hole formed at the first sidewall and/or second sidewall, and wherein a seal member is provided between the moving member and an inner circumferential surface of the through-hole.

8. The developing cartridge according to claim 7, wherein the seal member includes a cylindrical shape and includes flange parts at both end portions thereof regarding the extending direction of the moving member, the flange parts being mounted to sandwich the first sidewall or second sidewall.

9. The developing cartridge according to claim 7, wherein the seal member has a cylindrical shape and has a length L in the extending direction of the moving member, which is larger than a moving distance D, which is the distance the moving member moves toward the second sidewall.

10. The developing cartridge according to claim 1, wherein the housing includes a cylinder-shaped member that is mounted between the first sidewall and the second sidewall, and wherein the moving member is inserted into the cylinder-shaped member and is movably supported.

11. The developing cartridge according to claim 1, wherein the second part is an electrode part.

12. The developing cartridge according to claim 1, wherein the moving member is configured to move from the first side wall to the second side wall along the second axis line by a pushing force from the first sidewall to the second sidewall along the second axis line.

13. A developing cartridge comprising:

a housing configured to accommodate developer therein, the housing including:

a first sidewall; and a second sidewall opposed to the first side wall;

a developing roller received by the first sidewall and the second side wall, and configured to rotate about a first axis line;

a coupling disposed at the first side wall and configured to rotate about a second axis line parallel with the first axis line, the coupling configured to rotate to the developing roller; and a moving member received by the first sidewall and the second sidewall and extending along the second axis line, the moving member configured to move between the first side wall and the second side wall along the second axis line, wherein the moving member includes:

a first part being disposed at one end of the moving member along the second axis line, and a second part being disposed at an other end of the moving member along the second axis line, the second part configured to be electrically connected to the developing roller, and the second part configured to protrude from the second sidewall based on moving of the moving member.

14. The developing cartridge according to claim 13, further comprising a press member configured to press the moving member from the second side wall to the first side wall, wherein the coupling is disposed on an outer surface of the first sidewall, wherein the moving member is configured to move from the second sidewall to the first sidewall along the second axis line based on pressing of the pressing member, and wherein the first part is configured to protrude from the coupling based on moving of the moving member from the second sidewall to the first sidewall.

15. The developing cartridge according to claim 13, wherein the second part is an electrode part.

16. The developing cartridge according to claim 13, wherein the moving member is configured to move from the first side wall to the second side wall along the second axis line by a pushing force from the first sidewall to the second side wall along the second axis line.

17. A developing cartridge comprising:

a housing configured to accommodate developer therein, the housing including:

a first sidewall; and a second sidewall opposed to the first side wall;

a developing roller received by the first sidewall and the second side wall, and configured to rotate about a first axis line;

a coupling disposed at the first side wall and configured to rotate about a second axis line parallel with the first axis line, the coupling configured to transfer rotational force to the developing roller; and a moving member received by the first sidewall and the second sidewall and extending along the second axis line, the moving member configured to move from the first side wall to the second side wall along the second axis line in a first state, wherein the moving member includes:

a first part being disposed at one end of the moving member along the second axis line, and a second part being disposed at an other end of the moving member along the second axis line, the second part configured to be electrically connected to the developing roller, and the second part configured to protrude from the second sidewall in the first state.

18. The developing cartridge according to claim 17, further comprising a press member configured to press the moving member from the second side wall to the first side wall, wherein the coupling is disposed on an outer surface of the first sidewall, wherein the moving member is configured to move from the second sidewall to the first sidewall along the second axis line in a second state, wherein the first part is configured to protrude from the coupling in the second state.

19. The developing cartridge according to claim 17, wherein the second part is an electrode part.

20. The developing cartridge according to claim 17, wherein the moving member is configured to move from the first side wall to the second side wall along the second axis line in the first state by a pushing force from the first sidewall to the second side wall along the second axis line.

* * * * *